US007611017B2

(12) United States Patent
Ottmann

(10) Patent No.: US 7,611,017 B2
(45) Date of Patent: Nov. 3, 2009

(54) METHOD OF SORTING CONTAINERS

(75) Inventor: Marc Ottmann, Kurtzenhouse (FR)

(73) Assignee: Sidel Participations, Octeville sur Mer (FR)

( * ) Notice: Subject to any disclaimer, the term of this patent is extended or adjusted under 35 U.S.C. 154(b) by 57 days.

(21) Appl. No.: 11/572,019

(22) PCT Filed: Jul. 5, 2005

(86) PCT No.: PCT/EP2005/053210

§ 371 (c)(1),
(2), (4) Date: Oct. 30, 2007

(87) PCT Pub. No.: WO2006/005702

PCT Pub. Date: Jan. 19, 2006

(65) Prior Publication Data

US 2008/0121569 A1 May 29, 2008

(30) Foreign Application Priority Data

Jul. 15, 2004 (EP) ..... 04291829

(51) Int. Cl.
*B07C 5/00* (2006.01)

(52) U.S. Cl. ..... 209/523; 209/522

(58) Field of Classification Search ..... 209/522, 209/523

See application file for complete search history.

(56) References Cited

U.S. PATENT DOCUMENTS 3,771,649 A * 11/1973 Strauss ..... 209/3.1

FOREIGN PATENT DOCUMENTS

DE 25 34 183 2/1977

(Continued)

*Primary Examiner*—Patrick H Mackey
*Assistant Examiner*—Terrell H Matthews
(74) *Attorney, Agent, or Firm*—Paul & Paul

(57) ABSTRACT

The present invention concerns a method of sorting containers (9), fed arranged in bundles (8) according to a matrix which are examined for affiliation with a sort, removed from the bundles (8) and, separated by sort, and put into bundles (8) again. The object of the invention, to create a method of the aforementioned type which allows the automatic sorting of a fairly large number of containers and/or bundles per unit of time without excessive financial outlay, is achieved by the method according to the invention comprising a first step consisting in the examination of all the containers contained in a bundle in view of the determination of their respective sort (A, B, C or D), a second step wherein the result of said first test of the containers (9) for affiliation with a sort (A, B, C or D) is used to control a first robot (13) in such a way that this robot removes all the containers (9) of all the sorts from the bundle (8) together and puts them according to their specific sort on separate conveyors (4), each said separate conveyor being assigned to a specific sort, which second step is followed by a transfer of the containers (9) by means of the respective conveyors on which they have been put to a collection table (15) on which they are stored until enough containers (9) of a sort (A, B, C or D) have constituted a full matrix, after which a second robot (16) removes all the containers (9) of said full matrix from the collection table (15) and puts them in a predetermined bundle (8).

(Continued)

11 Claims, 3 Drawing Sheets

U.S. PATENT DOCUMENTS

| | | | | | |
|---|---|---|---|---|---|
| 4,239,116 | A * | 12/1980 | Eisenberg et al. | ..... | 209/523 |
| 5,305,892 | A * | 4/1994 | Kronseder | ..... | 209/523 |
| 5,314,072 | A * | 5/1994 | Frankel et al. | ..... | 209/44.1 |
| 5,505,311 | A * | 4/1996 | Kronseder et al. | ..... | 209/522 |
| 6,427,096 | B1 * | 7/2002 | Lewis et al. | ..... | 700/228 |

FOREIGN PATENT DOCUMENTS

| | | |
|---|---|---|
| DE | 39 17 541 | 3/1990 |
| DE | 200 06 059 | 12/2000 |
| EP | 1 445 038 | 8/2004 |

* cited by examiner

Fig. 3
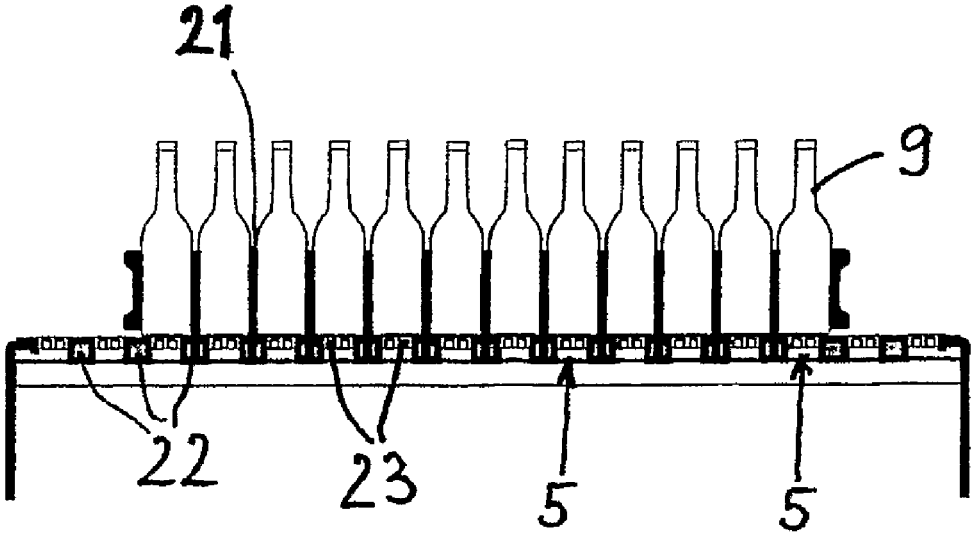
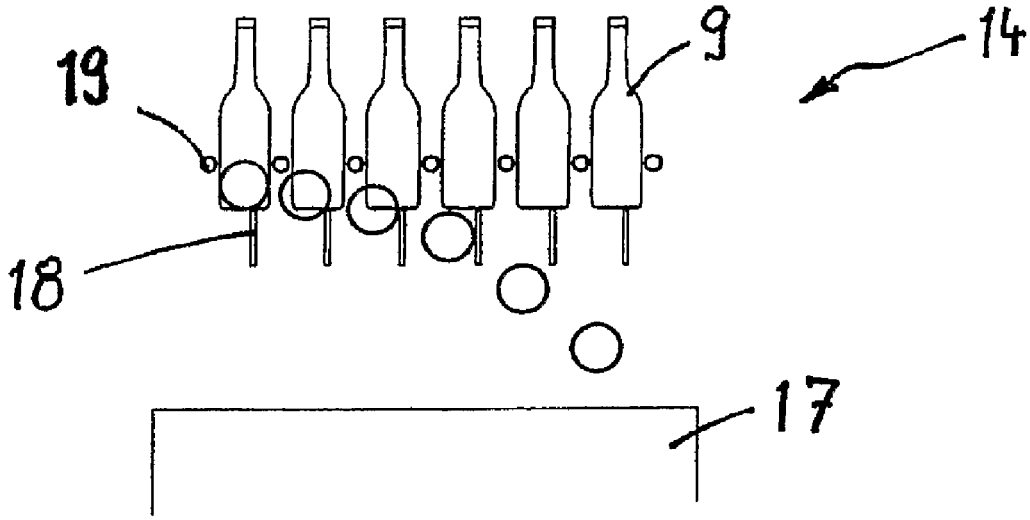
Fig. 2

METHOD OF SORTING CONTAINERS

BACKGROUND OF THE INVENTION

The invention relates to a method of sorting containers, fed arranged in bundles according to a matrix, which are examined for affiliation with a sort, removed from the bundles and, separated by sort, are rebundled.

Numerous similar sorting methods are known, in particular in connection with bottles as containers and cases as bundles. If it is desired to produce unmixed bundles, then if the user so desires only one sort of container may appear in a bundle, and if possible the bundle should be completely full. In a concrete case cases of a certain sort are completely filled with containers of a certain sort. The bundles determine a matrix with a predetermined number of spaces, for 3×4 bottles for example when the containers are bottles for drinks cases.

In a known method unmixed cases, filled with containers, are obtained. It will be wished to reduce space and costs inter alia by dispensing with an intermediate storage of containers and instead putting the removed and fed containers in cases directly without intermediate storage and without stacking. In this way the known containers of a bundle are removed individually one after another and put in other bundles individually one after another. By a special system the containers are recognized according to the known method and assigned to container bundles accordingly. The containers are transferred via a robot.

A disadvantage with this known method is the low throughput of containers. The mechanical means used to carry out the known method require forces of gravity and leverage in the robots and conveyance apparatus to move the bundles, so that the movements provided for there allow only a small boost. A further disadvantage is that, because of the available filling spaces, containers and bundles must always be in a particular relationship to each other. If these spatial relationships do not exist, these must be restored by time delays. However during such waiting times a robot cannot work for example. This delays the sorting.

Considerations have been made recently to provide a method of sorting containers having an increased flow rate and reduced space requirement thereby facilitating the manipulation of a plurality of sorts of bottles. To achieve this object a robot is provided but only a single robot. Additionally, bottle tables are arranged in different levels. With other words one conveyor is super imposed a separate conveyor resulting in different levels. The single robot has complicated rotating/lifting movements. There are conveyors having a horse shoe shape, and also to allow a return trip the use of the super imposed conveyors is required. The specific shape of the conveyors is also for the robot to be able to put the bottles on the intended locations and to remove them from other locations.

The use of super imposed conveyors makes the maintenance of the system more difficult, because there is a problem of accessibility. Further it exists the risk, especially in the case of glass bottles, when a bottle transported on an upper conveyor from a first location to a second location is broken, that glass fragments fall into containers transported on the lower level conveyor, so that those containers become polluted.

Moreover since only one robot is used, the speed of the consider system is reduced.

SUMMARY OF THE INVENTION

The object of the invention is therefore to create a method of the afore-mentioned type which allows the automatic sorting of a fairly large number of containers and/or bundles per unit of time without excessive financial outlay.

With the method according to the invention comprising a first step consisting in the examination of all the containers contained in a bundle in view of the determination of their respective sort, a second step wherein the result of said first step is used to control a first robot in such a way that this robot removes the containers of all the sorts from the bundle together and puts them according to their specific sort on separate conveyors, each said separate conveyor being assigned to a specific sort, which second step is followed by a transfer of the containers by means of the respective conveyors on which they have been put to a collection table on which they are stored by sort until enough containers of a sort have constituted a full matrix, the afore mentioned object is achieved by that thereafter a second robot removes all the containers of said full matrix from the collection table and puts them in a predetermined bundle, whereby said two separate conveyors are extending parallel and are situated on the same level.

According to a preferred embodiment, when a matrix to be constituted is of the a×b type with a being the number of rows of containers to be placed in a bundle and b the number of containers to be placed in each row of the bundle, then each separate conveyor has b parallel transport lines and, when a containers lie alongside one another in each transport line, then the second robot removes all the containers of said full matrix from the collection table and puts them in a predetermined bundle.

This embodiment applies whatever the number a of rows may be, including a=1.

In a variant, when matrices having each only one row of c containers have to be constituted, then the method consists in using separate conveyors which are each made of one transport line only, and, when c containers lie alongside one another in a transport line, then the second robot removes all the containers of said line from the collection table and puts them in a predetermined bundle. In other words matrices of the c×1 type are constituted.

Through these measures the invention achieves an increased speed and thus a high throughput capacity. The reason for these advantages is the different nature of the sorting. Even before the containers are removed from the fed bundle by means of the first robot, the control unit received the result of a test, namely of the type where each sort of container is marked in the control unit of the first robot Consequently the robot can remove all the containers of all the sorts from the bundle together and to do this requires only a single movement type; or the gripping arm of the robot needs to call at the pre-selected space only once.

Because there are at least two specific sorts of containers, there are also at least two conveyors arranged in parallel, onto which the containers—without bundles—are deposited. Initially the first conveyor, which is assigned to the first sort, receives all the containers of the first sort, then the second conveyor, which is assigned to the second sort, receives all the containers of the second sort. The conveyors then move these containers assigned to a certain sort to a collection table, in the area of which said second robot is arranged. The containers are then stored on the collection table until the previously defined matrix is filled up, for example the register is full for a case for drinks. The second robot recognizes this situation and thereafter removes first containers present on the collection table in the area of this matrix and puts them in a predetermined bundle provided alongside.

As regards the containers, for example drinks bottles, sorts are defined before entry into the sorting installation. The containers can for example have a different size, shape, colour and label. The same is true for the bundles also. In practice it has proved to be expedient if for example only bundles of the same basic size and of the same basic shape are handled.

As regards the bundles, for examples the cases for drinks bottles, the bundles are sorted so as to start from a certain size and shape, so that sorting in the sorting installation is only by colour and label for example. For the basic shape, the bottom shape of the bundle is important among other things. The bottom can for example have on two edges a recess into which a projection of a bundle positioned under it in each case can then project. When the exterior shape is the same a distinction can be drawn between different internal shapes for the basic shape which remains the same, thus constant external measurements without regard to the internal shape.

Similarly the container is examined and tested for the same basic shape and basic size. For example the size of the floor space of the container and its height can be established. Sorting is then by the criteria of colour and label.

When putting into practice the method according to the invention the throughput of sorted containers can be increased, in particular as there need not be a strictly preset matching of the number of containers and the number of corresponding bundles available. Thanks to the measures according to the invention an automatic, high-performance sorting installation is produced.

According to the invention it is also favourable if, with n different sorts of containers, n conveyors run parallel to each other at least from an unpacking device to a packing device and each robot preferably scans two conveyors. If for example in a bundle (a drinks case) there is a a×b matrix (a rows of b bottles to be inserted into the case), the assigned conveyor expediently has b parallel transport lines, and when the matrix is full a containers lie alongside one another in each transport line in each case. This applies for each sort. When there are two sorts (n=2), so that in a so-called unpacking device two conveyors then run parallel to each other. Each conveyor expediently reaches a packing device, arranged at a distance from the unpacking device, in which the sorted containers are put into the correct bundles. In the area of the unpacking device the so-called first robot, which is arranged next to the two conveyors, serves as unloading device, because the gripping arm of this first robot travels over the fed bundle, catches hold of the electronically marked containers there and then in the course of a swivel movement operates the conveyors of both sorts. It is clear that with a small space requirement the operating time is thus shortened and thus the capacity of the installation can be increased.

It is also expedient if according to the invention when there are several conveyors the containers in the area of the unpacking device are fed between the conveyors. The wholly unordered containers and bundles can be fed to the unpacking device according to this teaching at a particularly advantageous point, namely between the conveyors, because the swivel movement to neighbouring conveyors is then shorter and the capacity of the machine is improved. When there are four different sorts for example four conveyors are provided. The feeding of the still unordered and unsorted containers then takes place between the conveyors in such a way that both on the one and on the other side of the feed position two conveyors each are running. It is particularly favourable if the feed direction runs parallel to the direction of movement of the conveyors. When there are six conveyors and six sorts then respectively three conveyors each run on each side of the feed positions in the area of the unpacking device.

It is also advantageous, if according to the invention two unpacking devices with in each case a first robot are arranged one behind the other in the direction of movement of the containers. The feed position of the containers fed unsorted is thus doubled in size, because double the quantity of containers can be fed and then handled.

In an advantageous development of the invention the containers, after leaving the unpacking device, pass through a trap for separating out non-sortable containers. If for example the bottom shape or the height of a container cannot be assigned to a predetermined sort, this container is non-sortable. It can be however transferred by one of the conveyors assigned to predetermined sorts until it reaches the trap through which it is removed. In a bottling plant for drinks even objects other than containers can be fed, whose characteristics do not fit the predetermined sorts, such as for example closures of bottles, foils, paper residues or other plastic parts. In the named case these are identified and separated out in such a way that only sortable containers are still moved in the direction of movement behind the trap.

According to the invention, it is also favourable if the bundles at least partly filled with containers are combined on a collective bundle and are fed between respectively n/2 conveyors, with $n \geqq 2$ to the at least one unpacking device. In a special version the containers are bottles, the bundles are the cases for housing these bottles, and the collective bundle is a pallet, preferably a Europe pallet. According to this example, bottles of different sorts, for example four sorts, are put unordered and arbitrarily in drinks cases, which in the preferred version belong to several different sorts arranged one behind the other and unordered. Thus one case, according to the colour label, can be a beer case, the other a case for juice bottles, and others can be cases for water, etc. These unsorted cases, which are filled unsorted with containers, can optionally be immediately combined on a collective bundle, i.e. on a pallet, and be fed to this on a middle area of the unpacking device. When there are two conveyors, the feed position is located between one conveyor in each case. When there are four conveyors between two conveyors in each case, and optionally when there is an odd number n, a conveyor can be arranged on one of the two sides more than on the other side. However it is also conceivable that the containers in the bundles without a collective bundle, that is the bottles in the cases without pallets, are fed to the unpacking device. Through the invention it is possible, if the collective bundle or the pallet is initially disregarded, to put wholly unordered containers into unordered bundles and feed them to the sorter in order that, on the output side according to requirements and demand, sorted bundles can be removed with containers that are filled sorted. Thanks to the feeding of the unordered bundles between respectively n/2 conveyors, the sorter installation becomes compact and occupies less space for one thing, and for another a robot which is used can scan either several conveyors on one side or even all the conveyors on both sides with a gripping arm, so that the time for the sorting of the containers is shortened.

If, in a development of the invention, the empty bundles on the collective bundle are fed to a separate installation for sorting of the bundles and enter the packing device sorted and empty without a collective bundle next to the collection table, it is possible to also sort the bundles themselves in a separate sorting installation. They can then enter the downstream packing device empty, preferably without a collective bundle, so that in a short time a robot can there again put sorted containers into defined prepared bundles. In another version the empty bundles can be fed even without a collective bundle directly on a conveyor of a separate sorting installation. The effects and advantages are the same in this version also.

It is also advantageous according to the invention if the bundles combined into one layer are fed to a loading device and then placed laterally on a collective bundle and moved off. It is assumed here that the bundles in the packing device are filled with the correct sorts of containers and then are combined to form said layer. In this form the bundles are then fed to the loading device, preferably also again in the middle between conveyance devices, in order to keep the paths of a cross-conveyor small and to allow the palletizing, if collective bundles are taken as pallets, to occur in shorter periods. From the approximately central feed position the bundles combined to form the determined, desired layer can be moved in a shorter time to one or the other side, i.e. to one or the other removal conveyor. It is provided that a collective bundle is already fed at this point, so that the filled bundles can be placed on this and moved off in this totality. The removal conveyor is again expediently similarly structured and arranged to the above-mentioned unpacking device. When there is a quantity $n \geqq 2$, the feed position for the composed bundles will again lie between respectively n/2 conveyors; with the addition that, when n is an odd number, one more conveyor is present on one of the two sides of the feed position, i.e. one conveyor on one side and two conveyors on the other side or two conveyors on one and three on the other side.

Also advantageously according to the invention, alongside the feed point of the delivered bundles a collective bundle can be introduced onto which the laterally moved bundles are lowered from the top downwards. If for example the direction of the conveyors and also of the removal conveyors is considered as x direction, then the above-mentioned bundles combined to form a layer are fed to the loading device in x direction and then moved laterally in y direction, assuming the direction y is perpendicular to direction x. At a height below the bundles, when they are composed or moved, a collective bundle is thus introduced in x direction. In order that the composed bundles can be assigned to such a collective bundle, the composed bundles are moved "laterally", i.e. in y direction, so that then after the lateral movement these bundles come to rest above a collective bundle which has been introduced. The bundles are then lowered in z direction from the top downwards and placed on the collective bundle. It is understood that the z direction again is conceived to be at a right angle to the surface covered by the directions x and y. Of course, in a suitably designed z-conveyor the collective bundle could be moved from the bottom upwards until it touches the composed bundles. In this way it is possible to combine the correct bundles for example for a previously selected conveyance purpose and to secure them on a collective bundle and secure them there.

Thanks to the above measures it is possible that already in the area of the packing device a robot contains stored sort test results in such a way that it removes all sorts of containers in the path of the gripping arm via the individual conveyors assigned to the different sorts together and loads them into pre-sorted bundles. In this way it is possible that the robot or other suitable gripping device scans only once a conveyor, a fairly large number of which are arranged next to each other in parallel, yet still puts the desired containers into the pre-sorted bundles. A sorting installation using this method according to the invention thus operates considerably faster.

Expediently a further development of the invention is that, on the path of the conveyors in the direction of movement, supplementary containers can be fed additionally and preferably individually before the collection table. The direction of movement is again the aforementioned x direction, in which at least one conveyor moves from the unpacking device at least to the packing device in which the collection table stands. According to requirements, this path or the conveyor or conveyors can be extended in such a way that additional containers can be put onto the conveyor concerned according to the desired sort. This feed can be either manual or via feed belts, which for example bring up the containers from the side. The additional feeding of empty containers according to the requirements of the order was not possible in the state of the art. On the outlet side of the conveyors, for example behind the packing device with the collection table, the user can require a certain piece number of a certain sort of containers which are not available in sufficient quantity on the inlet side, thus for example in the unpacking device. New containers already finish-sorted can then be added in the area before the collection table in such a way that the requirement of the outlet side is met. The reason for this desire to supplement with additional containers, optionally also individually, on one or more conveyors is often that on the inlet side unordered, for example used containers (or also cleaned containers) are not available in the desired quantity. Thanks to the measures according to the invention missing containers of the appropriate sort can now be easily supplemented.

BRIEF DESCRIPTION OF THE DRAWINGS

Other advantages, features and application possibilities of the present invention result from the following description of preferred embodiments in conjunction with the attached drawings, showing.

DETAILED DESCRIPTION OF THE INVENTION

Figure 1:
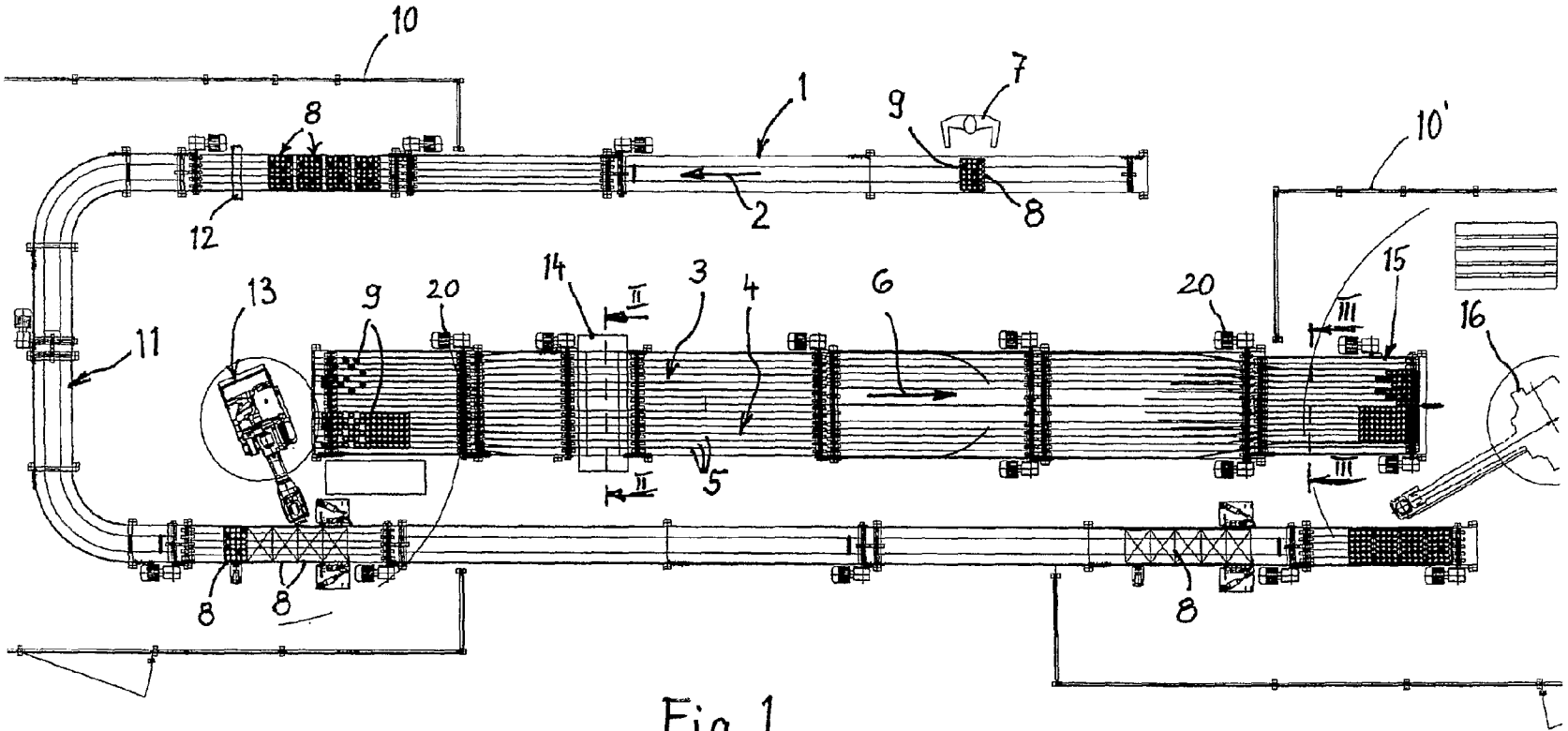
FIG. 1 The view from above of a sorting installation for containers in which two sorts of containers in the left-hand area are removed from a feed conveyor and placed, sorted, on two conveyors, at whose outlet side end sorted containers can be put into pre-sorted bundles, FIG. 2 a sectional view along the line II-II in FIG. 1, FIG. 3 a sectional view along the line III-III in FIG. 1 and FIG. 4 a view from above of a sorting installation of another version with unpacking device on the left and packing device and loading device on the right.

In FIG. 1 the view from above of a simple sorting installation is shown, in which a feed conveyor 1 is represented in the shape of a horizontal U with the direction of movement 2. In the middle of the U are two conveyors 3 and 4 arranged parallel to each other, which lie tight against one another and have several transport lines 5 each. In the embodiment shown on the figure, the conveyors 3 and 4 have six transport lines 5 each. The direction of movement of these conveyors 3 and 4 is numbered 6. A person 7 places a bundle 8 on the inlet side on the feed conveyor 1, in which black and white containers 9 are arranged occupying a a×b type matrix. In the present case a bundle 8 may be imagined as a drinks case and a container 9 as a bottle. The matrix is spanned by six rows with four gaps each. Thus there are 4×6 spaces in the matrix which is a 4×6 type matrix. If these are filled with containers 9, there are 24 containers 9 in a bundle 8.

The feed conveyor 1 moves the bundles 8 to the left in the direction of movement 2 at the top of FIG. 1. Located in a protective housing 10 is the section 11 connecting the two legs of the U-shaped feed conveyor. In the upper area adjoining this connecting section 11 four bundles 8 arranged one behind the other are seen, which are filled unordered with black and white containers, the black sort to be regarded as different from the second, white sort to aid understanding. The bundles 8 are moved further down by the feed conveyor 1 over the connecting section 11 of the U and to the right in the lower leg of the U. A row of five bundles 8 is shown there, of which only the left-most bundle is filled with containers and the other four bundles next to it on the right are represented by a X cross. In each of the bundles 8, which are assumed to belong to a single sort, are containers 9 of two different sorts (here: black and white).

Located in the area of the upper leg of the U at its left-hand, downstream end is an optical monitor 12, in which test signals for a control unit of the downstream robot 13 are produced such that the position and sort of all the containers in the bundle can be precisely determined. When the robot 13 travels over the bundle concerned for unpacking, it can remove all the containers 9 from the bundle 8 in one go and it "knows" from the electronic marking of the containers 9 where which containers are arranged in the matrix of the bundle. If the robot 13 then swivels approximately 100° counter-clockwise, so that it comes to a stop above the lower conveyor 4, then on command it transfers the white containers onto this conveyor 4. It is provided that all the white containers only reach the conveyor 4 and all the black containers are to be collected on the conveyor 3. After a short stop the robot 13 continues to turn counterclockwise until the gripper stands above the other, upper conveyor 3 and sets down all the black containers there. In this simplified example it is assumed that the matrix is filled in every bundle 8 with black and white containers and that no other objects or containers are present. Should this be the case in other versions, a sorting installation for two sorts could allow other, i.e. third and/or fourth sorts etc., to drop on the swivel path before or after the lower conveyor 4, into a bin, from where these are optionally disposed of. Through the swiveling of the robot once from the feed conveyor 1 over the conveyor 4 and then the conveyor 3, all the transport paths are thus passed through and the sorting process is completed so that the robot 13 then has only to swivel back empty. It is understood that these container transfer times are surprisingly very short.

Located on the lower conveyor 4 are now the sorted white containers, which are moved in the direction of movement 6 and over a trap 14 to the collection table 15. The same applies for the black containers 9. The collection table 15 is located in a downstream protective housing 10.

The empty bundles 8, five of which are represented and marked with X, arrive at the downstream end of the lower leg of the U-shaped feed conveyor 1. When there is further movement to the right these empty bundles 8 successively arrive at the right downstream end of the feed conveyor 1 which can be scanned in order to control the gripping arm of the second robot 16. Test signals are input into its control unit as to whether enough containers have arrived sorted at the downstream end of the collection table 15 on the conveyor 4 or 3 for a matrix to be full. In the case represented in FIG. 1 this is the case for a further bundle for the lower conveyor 4, but in the upper conveyor 3 black containers are still missing. Thus if bundles to be filled with white containers are lined up at the end of the feed conveyor 1, the gripping arm of the second robot 16 is controlled so as to swivel over the lower conveyor 4, there grip the filled matrix of containers 9, lift it off, swivel back and put it in the bundle 8. But if a bundle is to be filled with black containers, the second robot 16 "knows" from the test results input into it that the matrix is not yet filled with black containers. The second robot 16 will thus not even perform its swivel movement but will wait until enough black containers have been brought onto the collection table 15. From this principle it is also seen that very short sorting and transfer times are possible as long as enough containers are available for the transfer by means of the second robot 16.

FIG. 2 is a sectional view along the line II-II in FIG. 1. This concerns the trap 14, in the lower area of which a collection bin 17 is shown. Shown in the upper part of FIG. 2 are six containers 9 represented as bottles with the same basic surface and the same height and of the same sort. These containers 9 run next and parallel to each other in the direction of movement 6 on supports 18. These are located under each transport line 5 and support the containers on their track during the movement in direction of movement 6. The distance between the containers 9 is maintained by guide rods 19. No transport chain is provided in the trap 14 itself, rather the containers 9 on the supports 18 are pushed through the trap 14 by containers arriving upstream. This is also seen from the motors 20, also arranged downstream in each case, of the five conveyor sections. The objects not belonging to the desired sort of containers 9 fall through the trap 14, such as for example closures, plastic parts and the like. Containers 9 which are too high or too short or those with too small a floor area slip down alongside the supports 18 or fall over. In FIG. 2 six containers which have fallen over are shown schematically from their bottom side, which either cannot be held by the supports 18 or by the guide rods 19 and which consequently drop into the collection bin 17.

When the containers 9 finally reach the collection table 15 according to FIG. 3, they can adopt the position represented in FIG. 3 along the sectional line III-III in FIG. 1 on the right. The containers 9 are pushed between guide plates 21 and are held by these. On the bottom side they rest on guides 22 which each extend along the sides of the transport lines 5. In each transport line 5 the transport chain 23 is seen which is constituted by the conveyor 3 or the conveyor 4. The guide plates 21 can also cause a sideways shift during the movement of the container 9 in direction of movement 6, to the effect that the containers 9 previously moving at a fairly large separation distance from one another (see for example in FIG. 2) are pushed together to a smaller distance from one another (see for example FIG. 3). The desired matrix, one could also say the desired raster, can thereby be achieved.

Figure 4:
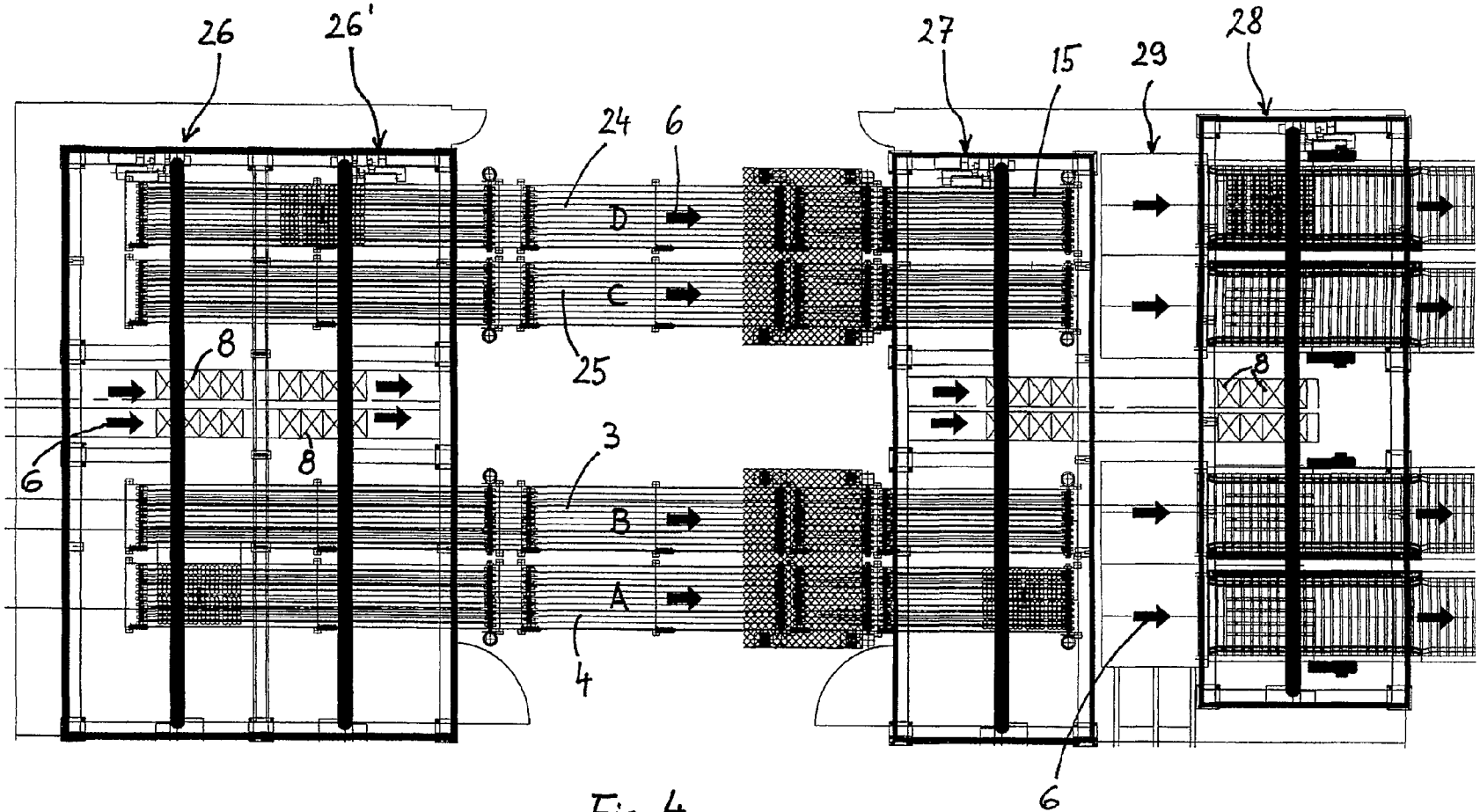

FIG. 4 shows a similar representation to FIG. 1, in which however four conveyors are provided, namely the lower two conveyors 3 and 4 and, arranged at a distance from these, the upper two conveyors 24 and 25. The direction of movement of all the conveyors is shown in each case by a black arrow and numbered 6. This direction of movement 6 can be imagined as running in x direction. The y direction can be imagined as perpendicular to this in the paper plane of FIG. 4. And perpendicular on the paper plane there runs a direction of movement z, not represented. In the part of the installation shown on the left in FIG. 4 there is an unpacking device 26 and to the right of it, down-stream from the latter in the direction of movement 6, is the unpacking device 26'. Roughly in the middle, unsorted empty material is fed from the left in the direction of movement 6. This arrives, in the case of the four conveyors 3, 4, 24, 25 shown here, in the area of the unpacking device 26, 26', between two conveyors in each case, namely the two conveyors 3, 4 shown at the bottom in FIG. 4 on the one hand and the upper two conveyors 24, 25 shown there.

For the sake of simplicity robots are not represented in FIG. 4, however a person skilled in the art knows that according to the example in FIG. 1 for example a first robot (there 13) operates the lower line of the bundles 8 and the two lower conveyors 3, 4, while a first robot arranged above it can scan the upper line of bundles 8 with the two upper conveyors 24 and 25. Alternatively a rather more expensive robot could also scan all four conveyors 3, 4, 24, 25 and the two parallel lines of the fed bundles 8. However the purpose of the installation is to achieve the short as possible movements and fast transfer times of the containers 9. Therefore the first-named alternative is particularly preferred in which only two conveyors and one line with bundles are each operated by one robot.

From the two unpacking devices 26, 26', the four conveyors 3, 4, and 24, 25 run in the direction of movement 6 as far as the packing device 27 represented in the middle with its four collection tables 15 allocated to the four conveyors.

In the unpacking device, any used and unsorted empty material in the form of containers 9 is unpacked from the unsorted bundles 8 and, with the help of the first robot 13 which is not shown, put on the conveyor of the sort concerned, thus on conveyor 4 of sort A, conveyor 3 of Sort B, conveyor 25 of sort C and/or conveyor 24 of sort D.

In a similar way to the installation of FIG. 1, the unpacking and transfer of the containers 9 takes place for example in the lower left quadrant of the unpacking device 26 such that test signals are input into the control unit of the first robot 13 from an upstream optical monitor 12 not shown here, so that all the containers are symbolically electronically marked. The robot can then remove all the containers 9 of all sorts from the first best bundle 8 together and separate them out into sorts A and B such that when travelling over the upper conveyor 3 all the containers of sort B are initially deposited on conveyor 3 and then the remaining containers of sort A are deposited on conveyor 4. In the representation in FIG. 4, 2×4 matrices are seen bottom left which are filled with white containers because in this example there were no black containers to sort.

As, in the left-hand lower quadrant the left-hand lower four bundles 8 were unpacked, so in the second unpacking device 26' the right-hand lower bundles 8 and then accordingly in the two upper halves of the unpacking devices 26 and 26' the upper bundles 8 are also unpacked.

The sorted containers are again conveyed to the right in the direction of movement 6 through the four conveyors 3, 4, 24 and 25 in FIG. 4 as far as the respective collection table 15.

After the bundles 8 are emptied, although they are also conveyed out of the unpacking devices 26 and 26' according to the representation with the two black arrows, they are conveyed to a separate sorting installation, not shown, for bundles and there they are sorted such that they are introduced, but sorted this time, in the middle of the packing device 27.

Located in the packing device 27 there is for example again in the lower half a second robot, not represented, which scans the two lower conveyors 3 and 4 and also the lower row of the bundles, now sorted and empty. The same applies laterally reversed for the upper part of the packing device 27. If a loading with only white containers is required for the respective bundle 8, the second robot receives an order to that effect and removes a matrix full of white containers 9 from the lower conveyor 4 and pours this directly into the respective bundle. The same would apply for an accumulation of the black containers, not shown, on the conveyor 3. If a bundle had to be filled with white containers and a second bundle with black containers alternately, these orders could be input into the control unit of the second robot, which always performs the shortest swivel paths and thus guarantees a fast transfer and thus sorting of the installation.

In the version represented in FIG. 4 a loading device 28 is connected downstream from the packing device 27 in the direction of movement 6. In the case of beer cases as bundle and beer bottles as container, pallets, in particular Europa pallets can be imagined as a collective bundle. These collective bundles, not represented, have a loading surface of 2×4 bundles. In other words, a pallet can be loaded with two rows of four drinks cases each. In order that there are again short transport paths for the third robot, not represented, an upper third robot operates the upper row of fed, full bundles 8 and the two upper loading units arranged above them. The inlet 29 for collective bundles lies under these units in z direction. Because four loading units are arranged next to each other, the four inlets 29, not shown, are arranged upstream from these units in the loading device 28 at a lesser height.

In the example shown here two rows of four bundles 8 can be combined into a layer, as is represented in the middle in the loading device 28. If this layer is to be moved away as sort C, the two rows of filled bundles 8 are shifted sideways in y direction upwards roughly to the height of sort C, and a collective bundle from the inlet of sort C is moved below this space from the left, so that the bundles can be lowered vertically onto the collective bundle and secured there.

In the examples shown, each of the conveyors 3, 4, 24, 25 is made of several parallel transport lines 5. However, for the following particular application implementable for constituting matrices having each only one row of c containers, the equipment could be modified in order to have separate conveyors 3, 4, 24, 25, each comprising one transport line 5 only. When c containers lie alongside one another in a transport line, then the second robot would remove all the containers of said line from the collection table and put them in a predetermined bundle. In other words matrices of the c×1 type would be constituted.

LIST OF REFERENCES

1 feed conveyor
2 direction of movement of feed conveyor
3 conveyor
4 conveyor
5 transport line
6 direction of movement of conveyors 3 and 4
7 person
8 bundle/case
9 container/bottle
10 protective housing
11 connection section of the U
12 optical monitor
13 robot
14 trap
15 collection table
16 second robot
17 collection bin
18 support
19 guide rod
20 motor
21 guide plate
22 guide
23 transport chain
24 conveyor
25 conveyor
26 unpacking device
26' unpacking device
27 packing device
28 loading device
29 inlet for collective bundles, feed position
A sort of container 9
B sort of container 9
C sort of container 9
D sort of container 9

The invention claimed is:

1. Method of sorting containers (9), fed arranged in bundles (8) according to a matrix which are examined for affiliation with a sort, removed from the bundles (8) and, separated by sort, put into bundles (8) again, comprising a first step consisting in the examination of all the containers contained in a bundle in view of the determination of their respective sort (A, B, C or D), a second step wherein the result of said first test of the containers (9) for affiliation with a sort (A, B, C or D) is used to control a first robot (13) in such a way that this robot removes all the containers (9) of all the sorts from the bundle (8) together and puts them according to their specific sort on separate conveyors (4), each said separate conveyor being assigned to a specific sort, which second step is followed by a transfer of the containers (9) by means of the respective conveyors on which they have been put to a collection table (15) on which they are stored until enough containers (9) of a sort (A, B, C or D) have constituted a full matrix, characterized in that a second robot (16) removes all the containers (9) of said full matrix from the collection table (15) and puts them in a predetermined bundle (8), that said two separate conveyors (1, 3, 4) are extending parallel and are situated on the same level and that with n different sorts (A, B, C, or D) of containers (9), n conveyors (3, 4, 24, 25) run parallel to each other at least from an unpacking device(26, 26') to a packing device (27) and each robot (13, 16) preferably scans two conveyors (3, 4, 24, 25).

2. Method according to claim 1, characterized in that a matrix to be constituted being of the a×b type with a being the number of rows of containers (9) to be placed in a bundle (8) and b the number of containers to be placed in each row of the bundle (8), then each separate conveyor (4) has b parallel transport lines (5) and, when a containers lie alongside one another in each transport line (5), then the second robot (16) removes all the containers of said full matrix from the collection table (15) and puts them in a predetermined bundle.

3. Method according to claim 1, characterized in that matrices to be constituted have each only one row of c, then the method consists in using separate conveyors (4) which are each made of one transport line (5) only, and, when c containers lie alongside one another in a transport line (5), then the second robot (16) removes all the containers of said line from the collection table and puts them in a predetermined bundle (8).

4. Method according to one of the claims 1 to 3, characterized in that, when there are several conveyors (3, 4, 24, 25), the containers (9) in the area of the unpacking device (26, 26') are fed between the conveyors (3, 4, 24, 25).

5. Method according to one of claims 1 to 3, characterized in that two unpacking devices (26, 26') with in each case a first robot (13) are arranged one behind the other in the direction of movement (6) of the containers (9).

6. Method according to one of claims 1 to 3, characterized in that the containers (9), after leaving the unpacking device (26, 26'), pass through a trap (14) for separating out non-sortable containers.

7. Method according to one of claims 1 to 3, characterized in that the bundles (8) at least partly filled with containers (9) are combined on a collective bundle and are fed between respectively n/2 conveyors (3, 4, 24, 25) with n≧2 to at least one unpacking device (26, 26').

8. Method according to one of claims 1 to 3, characterized in that the empty bundles (8) on the collective bundle are fed to a separate installation for sorting of the bundles (8) and enter the packing device (27) sorted and empty without a collective bundle, next to the collection table (15).

9. Method according to one of claims 1 to 3, characterized in that the bundles (8) combined into one layer are fed to a loading device (28) and then placed laterally on a collective bundle and moved off.

10. Method according to one of claims 1 to 3, characterized in that alongside the inlet (29) of the delivered bundles (8) a collective bundle can be introduced onto which the laterally moved bundles (8) are lowered from the top downwards.

11. Method according to one of claims 1 to 3, characterized in that on the path of the conveyors (3, 4, 24, 25) in the direction of movement (6) supplementary containers can be fed additionally and preferably individually before the collection table (15).

* * * * *